US009545658B2

(12) United States Patent
Shimoda et al.

(10) Patent No.: US 9,545,658 B2
(45) Date of Patent: Jan. 17, 2017

(54) PIERCING APPARATUS, PLUG USED FOR PIERCING APPARATUS, AND METHOD FOR PRODUCING SEAMLESS STEEL PIPE

(71) Applicant: NIPPON STEEL & SUMITOMO METAL CORPORATION, Tokyo (JP)

(72) Inventors: Kazuhiro Shimoda, Tokyo (JP); Tomio Yamakawa, Tokyo (JP); Kouji Yamane, Tokyo (JP); Yuji Inoue, Tokyo (JP); Syusuke Shimooka, Tokyo (JP); Kouji Muramatsu, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 95 days.

(21) Appl. No.: 14/353,041

(22) PCT Filed: Nov. 1, 2012

(86) PCT No.: PCT/JP2012/078315
§ 371 (c)(1),
(2) Date: Apr. 21, 2014

(87) PCT Pub. No.: WO2013/065780
PCT Pub. Date: Oct. 5, 2013

(65) Prior Publication Data

US 2014/0260494 A1 Sep. 18, 2014

(30) Foreign Application Priority Data

Nov. 1, 2011 (JP) ..... 2011-240609

(51) Int. Cl.
*B21B 19/04* (2006.01)
*B21J 9/04* (2006.01)
*B21B 25/00* (2006.01)

(52) U.S. Cl.
CPC ..... *B21J 9/04* (2013.01); *B21B 19/04* (2013.01); *B21B 25/00* (2013.01)

(58) Field of Classification Search
CPC ..... B21B 19/02; B21B 19/04; B21B 17/08; B21B 17/12; B21B 25/00; B21B 19/06; B21B 25/04; B21J 9/04; B21C 3/16
USPC ..... 72/96, 97
See application file for complete search history.

(56) References Cited

U.S. PATENT DOCUMENTS 4,928,507 A * 5/1990 Staat ..... B21B 19/02 72/358
5,706,689 A * 1/1998 Nery ..... B21B 25/00 72/208

FOREIGN PATENT DOCUMENTS

| | | | |
|---|---|---|---|
| CN | 101198420 | 6/2008 | |
| DE | 10309687 B3 * | 8/2004 | ..... B21B 25/00 |
| JP | 02-224856 | 9/1990 | |
| JP | 2001-162306 | 6/2001 | |
| JP | 2001-162307 | 6/2001 | |
| JP | 2009-18338 | 1/2009 | |

(Continued)

*Primary Examiner* — Debra Sullivan
(74) *Attorney, Agent, or Firm* — Clark & Brody

(57) ABSTRACT

There is provided a piercing apparatus in which the occurrence of an inner surface flaw in a hollow shell is suppressed. A piercing apparatus (10) according to an embodiment of the present invention is the piercing apparatus (10) which pierces a billet (18). The piercing apparatus (10) has a plug (14). The plug (14) has a through hole (30). The through hole (30) extends along the central axis, and allows the central portion of the billet (18) being pierced to pass therethrough.

11 Claims, 14 Drawing Sheets

(56) References Cited

FOREIGN PATENT DOCUMENTS

| | | |
|---|---|---|
| SU | 1315092 | 6/1987 |
| SU | 1761365 | 9/1992 |
| WO | 2004/052569 | 6/2004 |
| WO | 2006/134957 | 12/2006 |

* cited by examiner

PIERCING APPARATUS, PLUG USED FOR PIERCING APPARATUS, AND METHOD FOR PRODUCING SEAMLESS STEEL PIPE

TECHNICAL FIELD

The present invention relates to a piercing apparatus, a plug used for the piercing apparatus, and a method for producing a seamless steel pipe.

BACKGROUND ART

As a piercing apparatus for piercing a billet, for example, an inclined roll type piercing apparatus, a press roll piercing apparatus, and even a piercing press are available. The inclined roll type piercing apparatus is used for the production of seamless steel pipe using the Mannesmann process. The inclined roll type piercing apparatus produces a hollow shell by piercing-rolling a round billet.

The inclined roll type piercing apparatus includes, for example, a pair of inclined rolls and a plug. The paired inclined rolls are inclined with respect to the pass line. The plug is arranged on the pass line between the paired inclined rolls. On the inclined roll type piercing apparatus, the plug is pushed into a round billet while the round billet is rotated in the circumferential direction by the inclined rolls to piercing-roll the round billet into a hollow shell.

When the round billet is piercing-rolled into a hollow shell by using the inclined roll type piercing apparatus, a flaw (hereinafter, referred to as an inner surface flaw) may occur on the inner surface of the hollow shell. The inner surface flaw occurs, for example, through the mechanism described below. During the piercing-rolling, a Mannesmann fracture occurs on the round billet, and a flaw (crack) is formed in the central portion of the transverse cross section of round billet. The flaw formed in the central portion of round billet is turned to an inner surface flaw of the hollow shell by the piercing-rolling.

If the draft ratio of a plug nose is decreased, the inner surface flaw of hollow shell caused by the Mannesmann fracture can be reduced. However, as the draft ratio of the plug nose is decreased, the thrusting ability of round billet between the inclined rolls decreases. Therefore, it is preferable that the inner surface flaw of hollow shell can be reduced by any other method.

Techniques for reducing the inner surface flaw of hollow shell have been proposed in WO 2004/052569 (Patent Literature 1) and JP2009-18338A (Patent Literature 2).

In Patent Literature 1, a plug having a specific shape is used. This plug has a front end rolling portion, a work portion, and a reeling portion. The front end rolling portion has a columnar shape having an outside diameter d, and the front end surface thereof is formed in a spherical surface shape having a radius of curvature r. The work portion is formed by an arc rotating surface having a radius of curvature R so that the work portion is continuous with the front end rolling portion and the outside diameter thereof increases toward the rear end in the axial direction. The reeling portion is formed so as to be continuous with the work portion and has a predetermined taper angle such that the outside diameter increases toward the maximum outside diameter D at the rear end in the axial direction. The outside diameter d, the radius of curvature R, the axial direction length L1 of the front end rolling portion, the axial direction length L2 of the work portion, the axial direction length L3 of the reeling portion, and the outside diameter of a billet satisfy a predetermined relational expression.

In Patent Literature 2, a pusher device having a specific construction is used. This pusher device includes a cylinder device and a pusher mandrel. The cylinder device includes a cylinder shaft. The pusher mandrel is attached to the front end of the cylinder shaft. The front end of the pusher mandrel is brought into contact with the rear end of billet. The transverse cross-sectional area of pusher mandrel and the transverse cross-sectional area of billet satisfy a predetermined relational expression. The length of pusher mandrel and the transverse cross-sectional area of pusher mandrel satisfy a predetermined relational expression. The moved distance of the front end of cylinder shaft during piercing-rolling and the outside diameter of cylinder shaft satisfy a predetermined relational expression.

In both of the techniques in Patent Literatures 1 and 2, the Mannesmann fracture can be restrained. In some cases, however, a defect is present in the center of the transverse cross section of billet before piercing-rolling. Hereinafter, such a defect is referred to as a "center defect". The center defect is, for example, porosity or segregation occurring in the central portion of billet. The center defect includes a flaw formed in the central portion of billet. Even if the Mannesmann fracture can be restrained, if a billet having a center defect is piercing-rolled, the center defect is elongated and may appear on the inner surface of hollow shell.

Accordingly, to reduce the inner surface flaw attributable to the center defect in the billet, it is thought that the occurrence of defect is suppressed at the stage of a cast piece. For example, JP2-224856A (Patent Literature 3) discloses a technique for suppressing the occurrence of a vacancy-form defect in the central portion of the cast piece. In Patent Literature 3, before the solidification of the interior of cast piece drawn from a continuous casting mold is finished, the cast piece is forging-pressed continuously under predetermined conditions. However, it is difficult to completely eliminate the vacancy-form defect.

DISCLOSURE OF INVENTION

An objective of the present invention is to provide a piercing apparatus in which the occurrence of an inner surface flaw in a hollow shell is suppressed.

The piercing apparatus according to an embodiment of the present invention pierces a billet. The piercing apparatus includes a plug. The plug has a through hole. The through hole extends along the central axis of plug and allows the central portion of the billet being pierced to pass through.

The piercing apparatus according to the embodiment of the present invention is configured so that the occurrence of inner surface flaw in the hollow shell is suppressed.

DESCRIPTION OF EMBODIMENTS

Figure 1:
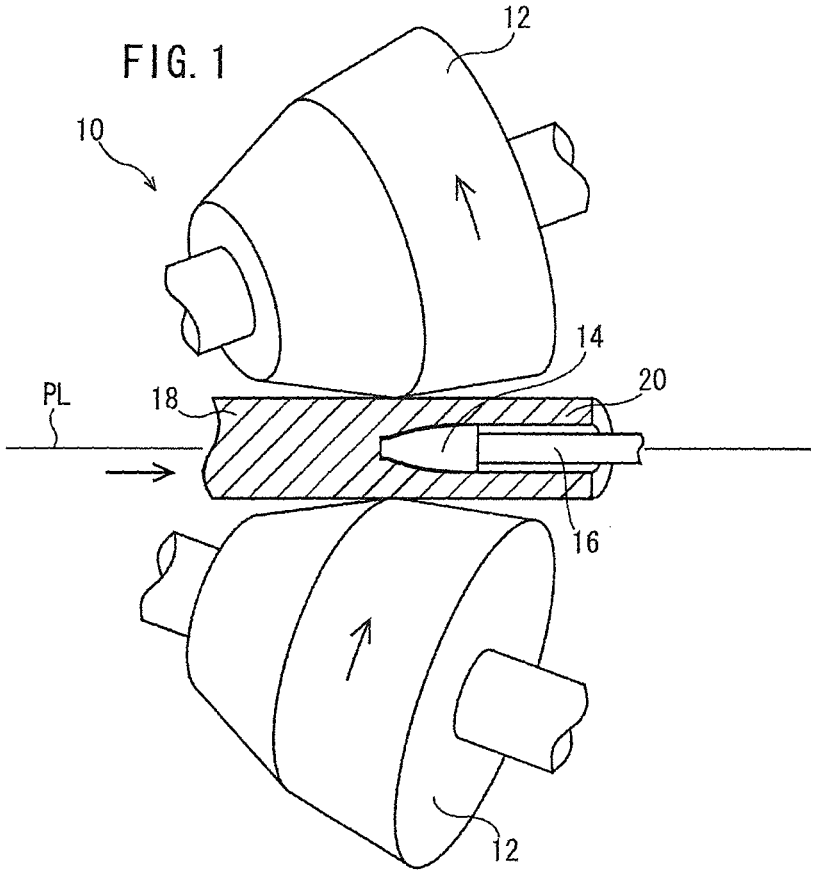
FIG. 1 is a schematic view showing a configuration of an inclined roll type piercing apparatus according to an embodiment of the present invention.

The piercing apparatus according to the embodiment of the present invention pierces a billet. The piercing apparatus includes a plug. The plug has a through hole. The through hole extends along the central axis of plug and allows the central portion of the billet being pierced to pass through.

In this case, when the plug pierces the billet, the central portion of billet passes through the through hole. Therefore, even if the billet has a center defect, an inner surface flaw is less liable to occur in the hollow shell.

Herein, the phrase of "the through hole extends along the central axis of plug" means that as viewed from the central axis direction of plug, the central axis of plug is positioned in the through hole. It is more desirable that the central axis of plug coincide with the center of through hole as viewed from the central axis direction of plug.

Preferably, the plug includes a shell part and a nose part. The shell part has an outside diameter that increases from the front end of the plug toward the rear end thereof. The nose part is provided at the front end of the shell part, and protrudes to the axial direction of plug. The through hole has an opening in the center of the front end of the nose part.

Preferably, the nose part has an outside diameter that increases from the front end of the plug toward the rear end thereof. The taper angle of the front end part of the shell part is larger than the taper angle of the rear end part of the nose part. In this case, the nose part is provided so as to protrude from the front end of the shell part. Therefore, when the plug pierces the billet, the contact area between the billet and the plug in the nose part becomes small. As a result, the heat input from the billet to the plug decreases, so that the plug is less liable to be subjected to a melting loss.

Also, the nose part has an outside diameter that increases from the front end of the plug toward the rear end thereof. Therefore, even if a melting loss occurs, the re-cutting allowance can be decreased. As a result, the plug can be used again after being re-cut.

The front end surface of the nose part may be flat. The peripheral edge of the front end surface may be rounded. The transverse cross-sectional shape of the through hole may be such that the transverse cross section increases from the front end of the plug toward the rear end thereof.

The piercing apparatus further includes a mandrel. The mandrel is connected to the rear end of plug. The mandrel has a connection hole extending on the central axis of mandrel and connectable to the through hole. In this case, the central portion of the billet having passed through the through hole enters into the connection hole in the mandrel.

The piercing apparatus may be a rolling piercing apparatus further including a plurality of rolls. The plurality of rolls are arranged around the axial direction of plug. The plurality of rolls may be inclined rolls or grooved rolls. In the case where the plurality of rolls are grooved rolls, the piercing apparatus further includes a pusher rod for pushing the billet into the plug.

The piercing apparatus may be a piercing press including a container for accommodating the billet and press-pierces the billet in the axial direction of billet by using a plug.

The plug according to an embodiment of the present invention is used for the piercing apparatus according to an embodiment of the present invention.

A method for producing a seamless steel pipe according to an embodiment of the present invention is carried out by using the piercing apparatus according to an embodiment of the present invention.

Hereunder, the piercing apparatus and plug according to an embodiment of the present invention are explained with reference to the accompanying drawings. In the figures, the same reference symbols are applied to the same or equivalent elements, and the explanation thereof is not duplicated.

[First Embodiment]

[Configuration of Piercing Apparatus]

FIG. 1 shows an inclined roll type piercing apparatus 10 used as the piercing apparatus according to an embodiment of the present invention. The piercing apparatus 10 includes a pair of inclined rolls 12, a plug 14, and a mandrel 16.

The paired inclined rolls 12 are arranged around a pass line PL. That is, between the paired inclined rolls 12, the pass line PL is positioned. The paired inclined rolls 12 are arranged so as to be inclined with respect to the pass line PL.

Although not shown, a guide for preventing bulging of the material during the piercing-rolling is provided between the paired inclined rolls 12. The paired inclined rolls 12 rotate a billet 18 in a helical fashion, and piercing-roll the billet 18 together with the plug 14. The inclined roll 12 may be of a cone type or a barrel type.

The plug 14 is arranged on the pass line PL between the paired inclined rolls 12. The plug 14 has a circular transverse cross-sectional shape, and the outside diameter thereof increases from the front end toward the rear end thereof. In one word, the plug substantially has a bullet shape.

When the piercing apparatus 10 piercing-rolls the billet 18, the plug 14 is pushed in the central portion of the fore end face (that is, the end face opposed to the plug 14) of the billet 18, whereby the billet 18 is pierced.

The mandrel 16 is arranged on the pass line PL, and extends to the pass line PL direction. The mandrel 16 has a role in fixing the plug 14 at a predetermined position. The front end of the mandrel 16 is connected to the rear end of the plug 14. For example, the rear end face of the plug 14 has a connection portion depressed in the axial direction, whereby the front end portion of the mandrel 16 is inserted into the connection portion of the plug 14 and is fixed to the plug 14.

In FIG. 1, the piercing apparatus 10 is of a two-roll type including the paired inclined rolls 12. However, the piercing apparatus 10 may include three or more inclined rolls that are arranged around the pass line PL.

[Configuration of Plug]

Figure 2A:
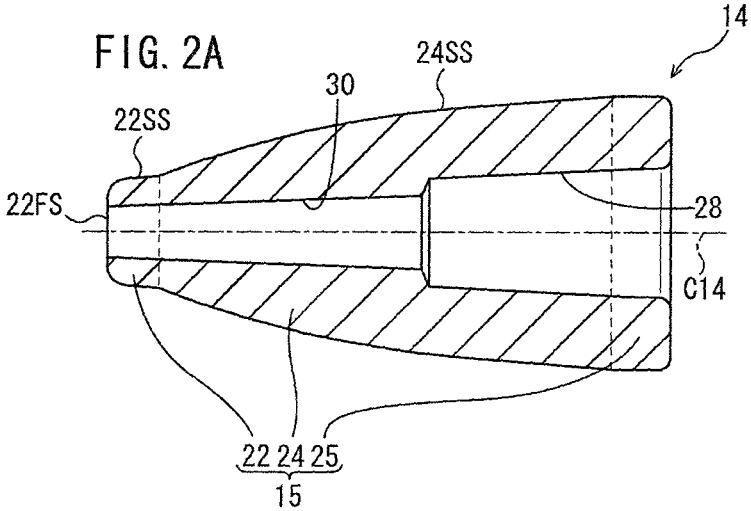
FIG. 2A is a longitudinal sectional view of a plug that the piercing apparatus shown in FIG. 1 has.

FIG. 2A is a longitudinal sectional view of the plug 14. As shown in FIG. 2A, the plug 14 has a body 15. The body 15 substantially has a bullet shape. The body 15 includes a nose part 22, a shell part 24 and a relief portion 25.

The nose part 22 is provided in the fore end portion of the plug 14, and forms the front end portion of the plug 14. The rear end of the nose part 22 connects with the fore end of the shell part 24.

The nose part 22 has a substantially columnar shape. The nose part 22 includes a front end surface 22FS and a side surface 22SS. The front end surface 22FS is provided in the front end portion of the nose part 22, and is opposed to the fore end face of the billet 18 before piercing-rolling. The side surface 22SS is arranged around a central axis C14 of the plug 14. The fore end of the side surface 22SS is connected to the peripheral edge of the front end surface 22FS.

Figure 2B:
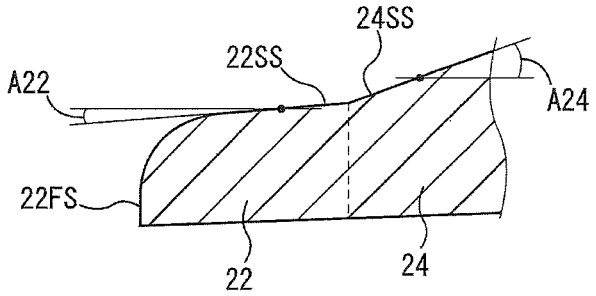
FIG. 2B is a longitudinal sectional view enlargedly showing a part of the plug shown in FIG. 2A.

As described above, the nose part 22 has a substantially columnar shape. Preferably, the nose part 22 has an outside diameter that increases from the front end of the plug 14 toward the rear end thereof. That is, the side surface 22SS preferably has a tapered shape. As shown in FIG. 2B, a taper angle A22 in the rear end portion of the nose part 22 is smaller than a taper angle A24 in the fore end portion of the shell part 24. The taper angle means an angle that the tangential line at the measurement position of a side surface 24SS (or the side surface 22SS) makes with a straight line parallel to the central axis C14. In FIGS. 2A and 2B, the taper angle of the side surface 22SS is substantially fixed.

The nose part 22 has a role in restraining the plug 14 from being subjected to a melting loss. Specifically, the nose part 22 is configured so that, when the plug 14 pierces the billet 18, the contact area between the billet 18 and the plug 14 in the nose part 22 becomes small, and resultantly, the heat input from the billet 18 to the plug 14 decreases, so that the plug 14 is less liable to be subjected to a melting loss.

The shell part 24 is provided on the rear side of the nose part 22 so as to be adjacent to the nose part 22. The shell part 24 has the side surface 24SS. The fore end of the side surface 24SS is connected to the rear end of the side surface 22SS. The outside diameter of the side surface 24SS increases from the front end of the plug 14 toward the rear end thereof.

As described above, in FIGS. 2A and 2B, the taper angle A24 in the fore end portion of the side surface 24SS is larger than the taper angle A22 in the rear end portion of the side surface 22SS. Therefore, the nose part 22 is provided so as to protrude from the fore end of the shell part 24.

The shell part 24 has a role in turning the billet 18 having a hole formed by the nose part 22 to a hollow shell 20 having desired inside diameter and wall thickness. Specifically, the shell part 24 comes into contact with the surface of the hole in the billet 18, that is, the inner surface of the hollow shell 20, and expands the inside diameter of the hollow shell 20. The piercing apparatus 10 rolls the hollow shell 20 while holding the hollow shell 20 between the shell part 24 and the inclined rolls 12. Thereby, the hollow shell 20 having desired inside diameter and wall thickness is produced.

At the rear end of the plug 14, a mandrel joint 28 is provided. The front end portion of the mandrel 16 is fitted in the mandrel joint 28, and the plug 14 and the mandrel 16 are connected to each other.

[Through Hole in Plug 14]

As shown in FIG. 2A, the body 15 of the plug 14 has a through hole 30. The through hole 30 is provided on the central axis C14 of the plug 14, and extends to the central axis C14 direction. One end of the through hole 30 is open in the center of the front end surface 22FS. The other end of the through hole 30 is open in the center of the bottom surface of the mandrel joint 28. That is, the through hole 30 penetrates the plug 14 in the axial direction.

The size of the through hole 30 may increase from the front end of the plug 14 toward the rear end thereof, or may be substantially fixed in the axial direction of the plug 14. The size of the through hole 30 is set as appropriate according to the size of the center defect in the billet 18. In the example shown in FIG. 2, the cross-sectional shape of the through hole 30 is circular.

[Method for Producing a Seamless Steel Pipe]

First, the billet 18 is heated in a heating furnace. The heated billet 18 is taken out of the heating furnace. By using the piercing apparatus 10 shown in FIG. 1, the heated billet 18 is piercing-rolled into the hollow shell 20.

As described above, the plug 14 has the through hole 30. Therefore, if the billet 18 is piercing-rolled by using the plug 14, the occurrence of inner surface flaw in the hollow shell 20 is suppressed. The reason for this is explained with reference to FIGS. 3 to 5.

Figure 3:
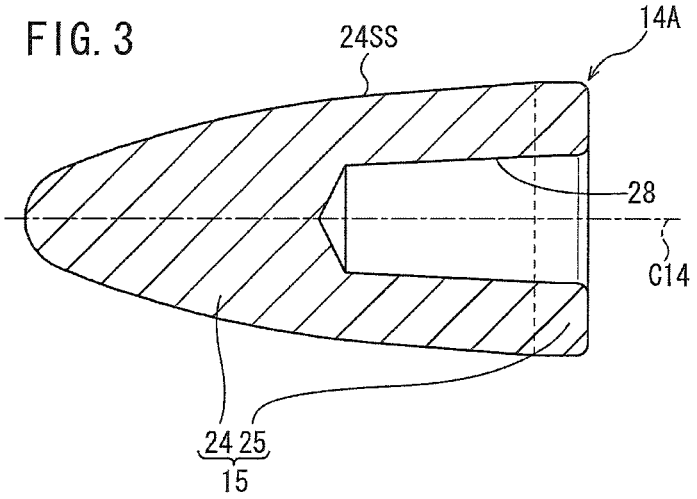
FIG. 3 is a longitudinal sectional view of a conventional plug having no through hole.
Figure 4:
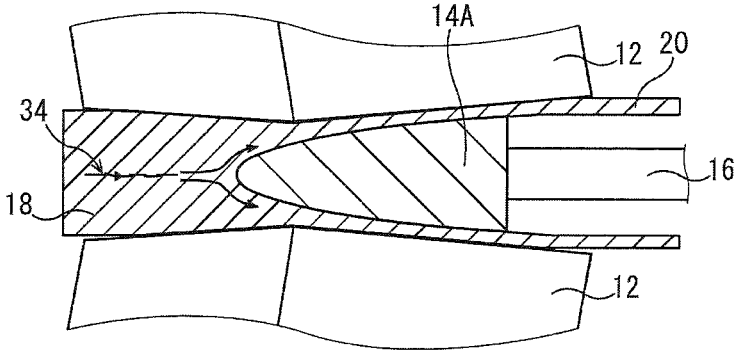
FIG. 4 is a schematic view showing a state in which a billet is piercing-rolled by using the conventional plug shown in FIG. 3.
Figure 5:
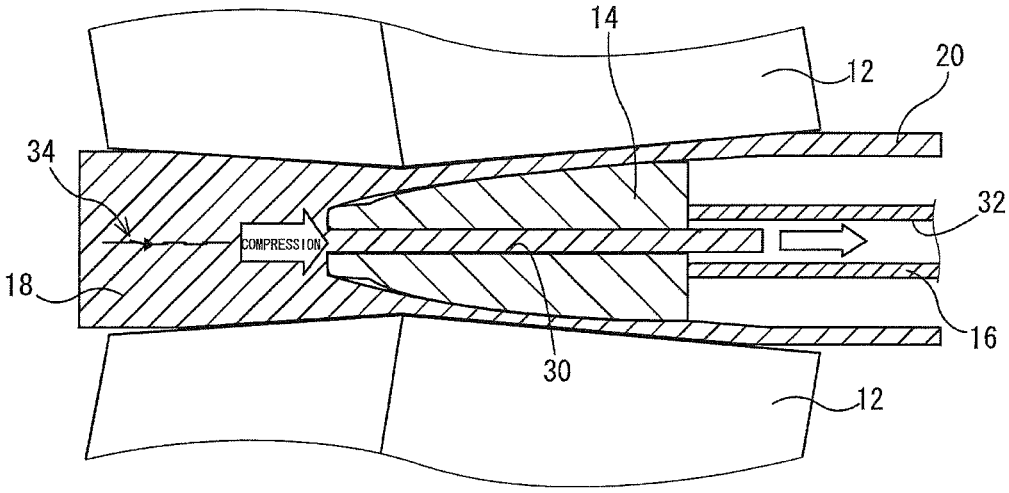
FIG. 5 is a schematic view showing a state in which a billet is piercing-rolled by using the plug shown in FIG. 2A.

FIG. 3 is a longitudinal sectional view showing a plug 14A having no through hole. The plug 14A is a plug having the conventional construction. The plug 14A has no through hole 30. FIG. 4 is a schematic view showing a process in which the billet 18 is piercing-rolled by using the plug 14A to produce the hollow shell 20. FIG. 5 is a schematic view showing a process in which the billet 18 is piercing-rolled by using the plug 14 to produce the hollow shell 20.

In the case where the plug 14A is used, a hole is formed in the central portion of the billet 18 coming into contact with the front end portion of the plug 14A. At this time, the central portion of the billet 18 is plastically deformed, passing through the periphery of the front end portion of the plug 14A, and forms an inner surface nearby portion of the hollow shell 20. Therefore, a center defect 34 of the billet 18 remains on the inner surface of the blank to form an inner surface flaw.

On the other hand, in the case where the plug 14 is used, the central portion of the billet 18 enters into the through hole 30. At this time, the central portion of the billet 18 is compressed in front of the plug 14. Such a compressive stress is created by the entry of the central portion of the billet 18 into the through hole 30. By this compressive stress, the center defect 34 is pressed. Further, a portion in which the center defect 34 is pressed passes through the through hole 30.

Figure 6:
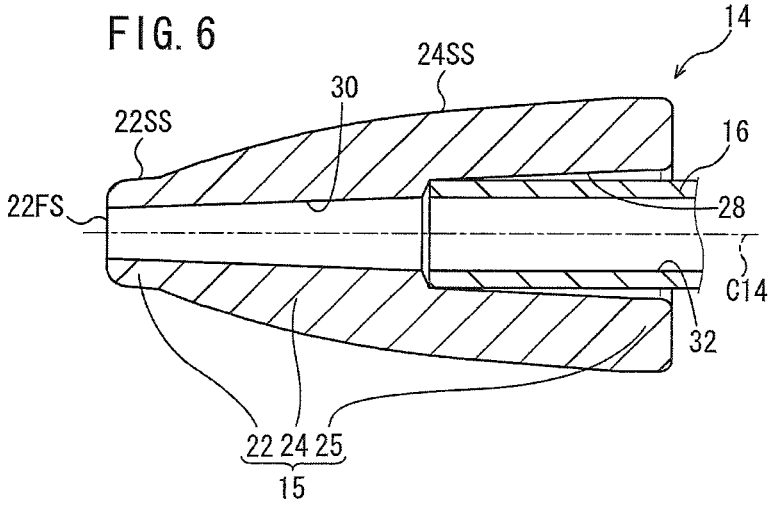
FIG. 6 is a longitudinal sectional view showing connection of the plug shown in FIG. 2A with a mandrel.

As described above, the rear end of the plug 14 is connected with the front end of the mandrel 16. As shown in FIG. 6, the mandrel 16 has a connection hole 32. The connection hole 32 extends along the central axis of the mandrel 16, and has an opening on the front end surface (the surface opposed to the rear end of the plug 14) of the mandrel 16. When the front end of the mandrel 16 is fitted in the mandrel joint 28, the through hole 30 is connected to the connection hole 32. Thereby, the central portion of the billet 18 passing through the through hole 30 is pushed out from the through hole 30 into the connection hole 32.

In effect, the plug 14 compresses the central portion of the billet 18 having a high possibility of containing the center defect 34, and allows it to pass through the through hole 30. That is, the piercing apparatus 10 piercing-rolls the billet 18 while the central portion of the billet 18 is allowed to pass through the through hole 30, whereby the hollow shell 20 is formed. For this reason, the central portion of the billet 18 does not form the inner surface of the hollow shell 20. Therefore, if the plug 14 is used, the inner surface flaw is less liable to occur in the hollow shell 20.

After the billet 18 has been piercing-rolled into the hollow shell 20, the hollow shell 20 is elongation-rolled by using, for example, a plug mill or a mandrel mill. After elongation-rolling, the shape is corrected by using, for example, a stretch reducer, a reeler, or a sizer. Thereby, the objective seamless steel pipe is produced.

[Second Embodiment]

The plug 14 shown in FIG. 2A includes the nose part 22 protruding from the shell part 24. However, a plug according to a second embodiment does not include the nose part 22.

Figure 7:
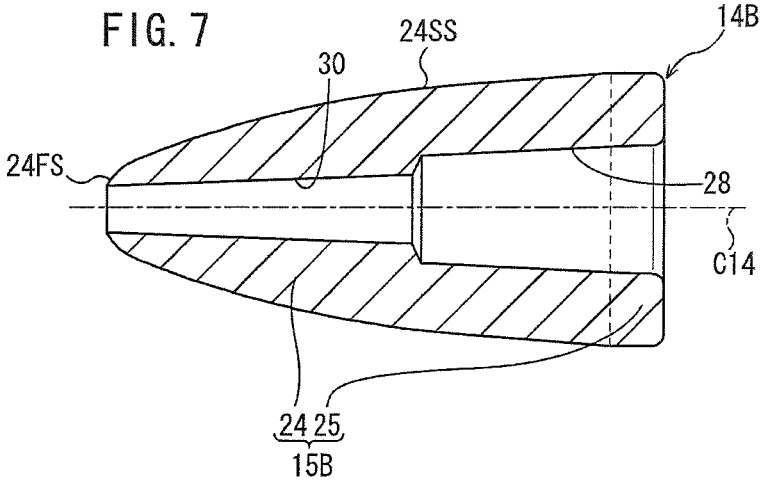
FIG. 7 is a longitudinal sectional view of another plug employable on the piercing apparatus shown in FIG. 1.

FIG. 7 is a longitudinal sectional view of a plug 14B of this embodiment having a shape different from the shape of the plug 14 shown in FIG. 2A. Referring to FIG. 7, the plug 14B includes a body 15B. The body 15B includes the shell part 24 and a relief portion 25.

The body 15B further includes the through hole 30. Like the plug 14, the through hole 30 extends along the central axis C14. One end of the through hole 30 is open in the center of the front end surface 24FS of the shell part 24.

Figure 8:
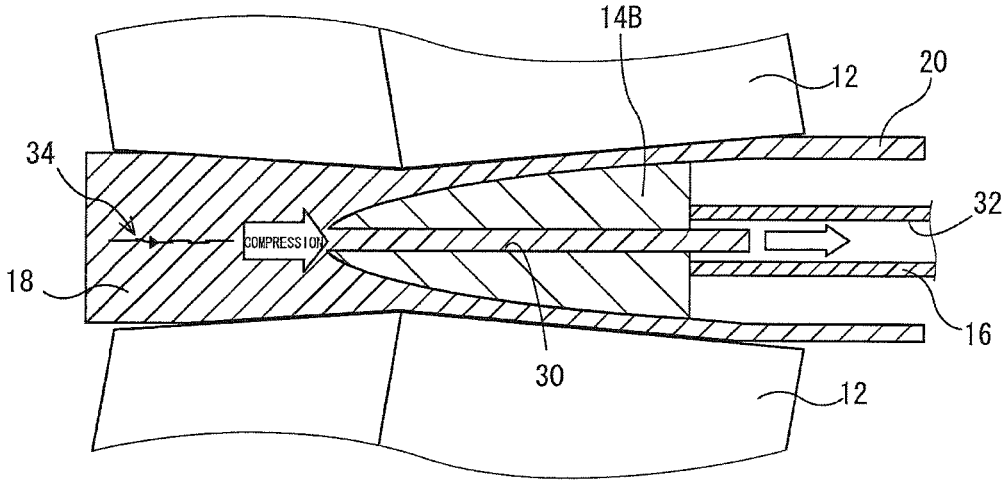
FIG. 8 is a schematic view showing a state in which a billet is piercing-rolled by using the plug shown in FIG. 7.

The plug 14B having the above-described configuration performs the same action as that of the plug 14. FIG. 8 is a schematic view showing a process in which the billet 18 is piercing-rolled by using the plug 14B to produce the hollow shell 20.

Referring to FIG. 8, when the billet 18 is piercing-rolled by using the plug 14B, as in the case where the plug 14 is used, the central portion of the billet 18 enters into the through hole 30. At this time, the central portion of the billet 18 is compressed in front of the plug 14B, and further passes through the through hole 30. In one word, the central portion of the billet 18 is not included in the hollow shell 20. Therefore, the inner surface flaw of the hollow shell 20 attributable to the center defect in the billet 18 is restrained from occurring.

[Third Embodiment]

Figure 9:
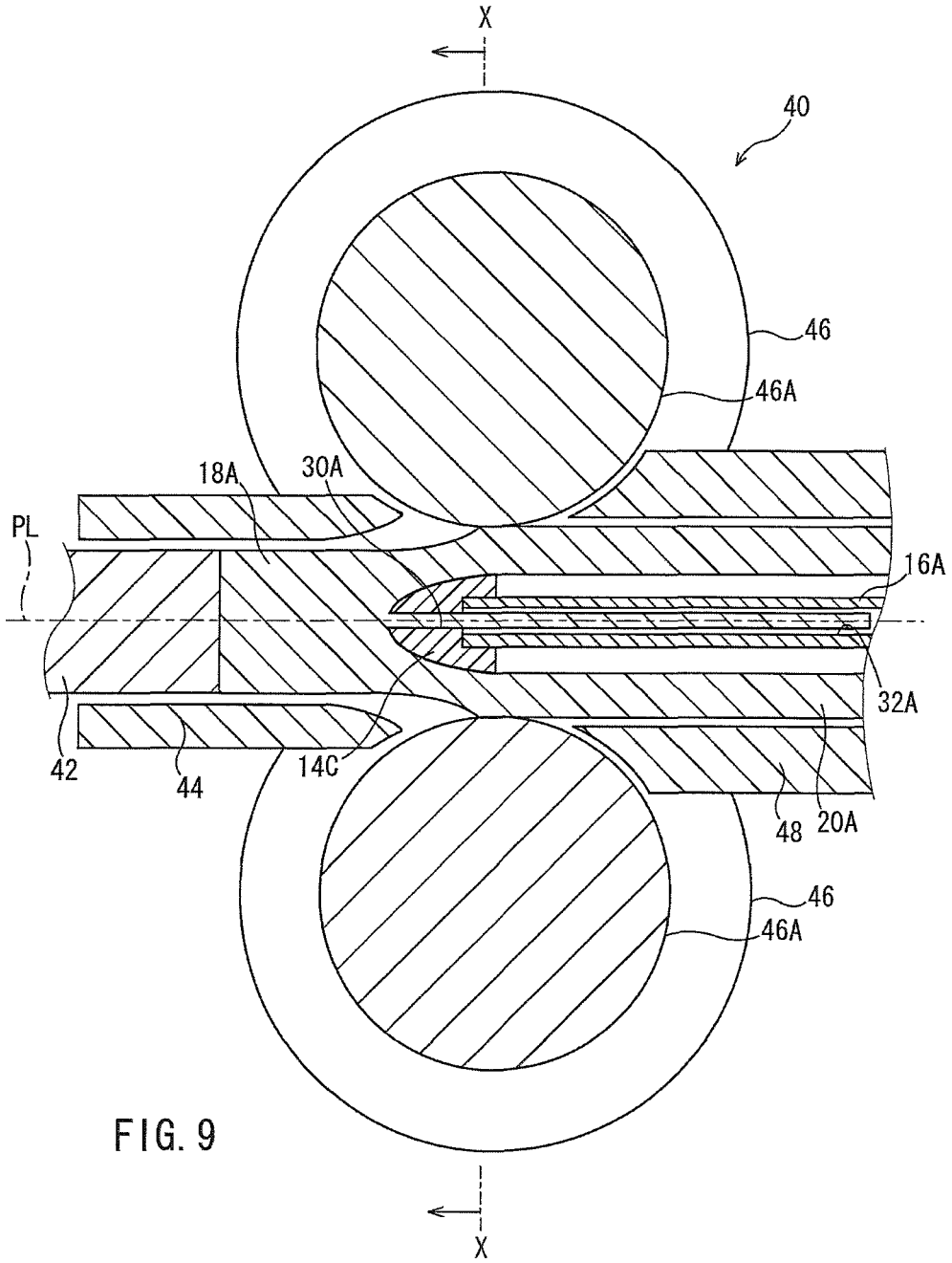
FIG. 9 is a schematic view showing a configuration of a press roll piercing apparatus according to an embodiment of the present invention.
Figure 10:
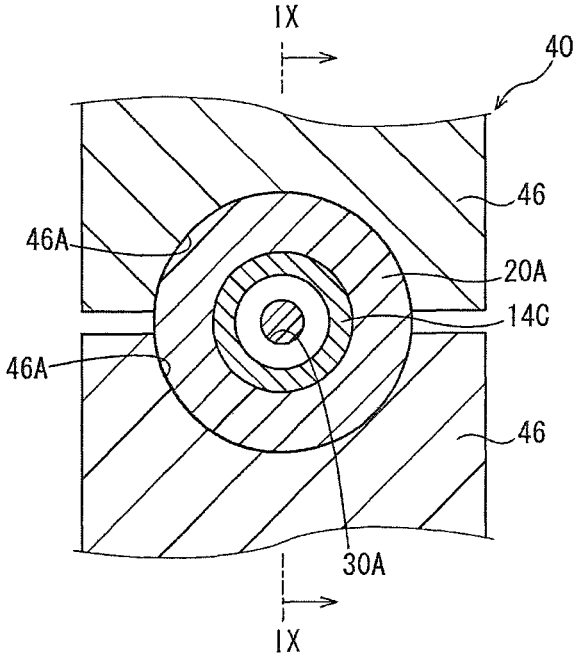
FIG. 10 is a sectional view taken along the line X-X of FIG. 9.

In the first embodiment, the inclined roll type piercing apparatus 10 has been explained. However, the piercing apparatus according to the embodiment of the present invention may be a press roll piercing apparatus 40 as shown in FIGS. 9 and 10.

The piercing apparatus 40 includes a plug 14C, a mandrel 16A, a pusher rod 42, an inlet guide 44, a pair of rolls 46, and an outlet guide 48.

The plug 14C is arranged on a pass line PL between the paired rolls 46.

The mandrel 16A is arranged on the pass line PL to support the plug 14C.

The pusher rod 42 is arranged on the pass line PL to push a square billet 18A toward the plug 14C.

The inlet guide 44 is arranged on the pass line PL to guide the square billet 18A to between grooves 46A that the paired rolls 46 have respectively.

The paired rolls 46 are arranged around the pass line PL. The paired rolls 46 piercing-roll the square billet 18A together with the plug 14C. Thereby, a hollow shell 20A is produced. Each of the paired rolls 46 has the groove 46A. By the paired grooves 46A, the outer peripheral surface of the hollow shell 20A is formed.

The outlet guide 48 is arranged on the pass line PL to guide the hollow shell 20A toward a predetermined direction.

On the piercing apparatus 40, the square billet 18A is pushed by the pusher rod 42. The square billet 18A pushed by the pusher rod 42 comes into contact with the plug 14C and the paired rolls 46. Thereby, the inner surface of the square billet 18A is pierced and expanded by the plug 14C, and the outer surface thereof is formed into a circular shape by the paired rolls 46. As the result, the hollow shell 20A is produced.

On the piercing apparatus 40, the plug 14C has a through hole 30A. Therefore, as in the case where the billet 18 is piercing-rolled by the piercing apparatus 10, the central portion of the square billet 18A enters into the through hole 30A. As a result, the inner surface flaw of the hollow shell 20A attributable to the center defect in the square billet 18A is restrained from occurring. The central portion of the square billet 18A having entered into the through hole 30A enters into a connection hole 32A in the mandrel 16A that supports the plug 14C.

[Fourth Embodiment]

Figure 11:
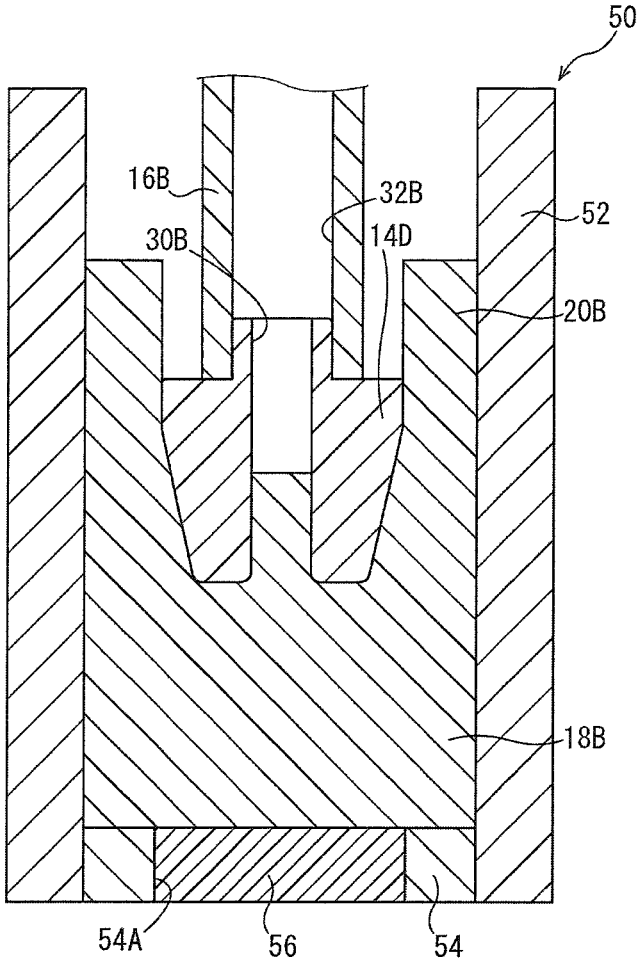
FIG. 11 is a schematic view showing a configuration of a piercing press according to an embodiment of the present invention.

FIG. 11 shows a piercing press 50 used as a piercing apparatus according to a fourth embodiment of the present invention. The piercing press 50 is used in the method for producing a seamless steel pipe by using a press system (for example, the method for producing a seamless steel pipe by the Ugine-Sejournet process).

The piercing press 50 includes a plug 14D, a mandrel 16B, a container 52, a bottom ring 54, and a backup point 56.

The plug 14D is arranged on the central axis line of a billet 18B to press-pierce the billet 18B.

The mandrel 16B is arranged on the central axis line of the billet 18B to support the plug 14D.

The container 52 has a tubular shape extending in the axial direction of the billet 18B, and accommodates the billet 18B.

The bottom ring 54 is arranged at the lower end of the container 52 to support the billet 18B. The bottom ring 54 has a center hole 54A. The diameter of the center hole 54A is slightly larger than the diameter of the plug 14D.

The backup point 56 has a block shape, and is arranged in the center hole 54A. The backup point 56 is supported, for example, by a hydraulic system.

On the piercing press 50, the plug 14D is moved toward the billet 18B. Then, the billet 18B is press-pierced by the plug 14D. Thereby, a hollow shell 20B is produced. When the press-piercing is finished, the backup point 56 is pushed by the plug 14D, and comes off the center hole 54A.

On the piercing press 50, the plug 14D has a through hole 30B. Therefore, the central portion of the billet 18B enters into the through hole 30B. As a result, the inner surface flaw of the hollow shell 20B attributable to the center defect in the billet 18B is restrained from occurring. The central portion of the billet 18B having entered into the through hole 30B enters into a connection hole 32B in the mandrel 16B connected to the plug 14D.

In the fourth embodiment, the bottom ring 54 and the backup point 56 are arranged at the lower end of the container 52. However, in place of this configuration, a die having an inside diameter slightly larger than the diameter of plug may be arranged.

As shown in the first to fourth embodiments, the plug of the present invention has only to have a through hole. In the present invention, the outer surface shape of the plug is not subject to any special restriction.

EXAMPLE 1

By using the plug shown in FIG. 2A (hereinafter, referred to as the plug of example embodiment of the present invention), a billet having a center defect was piercing-rolled, and a check was made whether or not an inner surface flaw occurred in a hollow shell. The steel type of billet was SUS420 specified in JIS Standard. The billet was heated at 1200° C. for one hour. The diameter of the billet was 70 mm. The axial direction length of the billet was 370 mm. The diameter of the through hole in the plug of example embodiment of the present invention was 10 mm. The axial direction length of the plug was 110 mm. The axial direction length of the nose part was 10 mm. The axial direction length of the shell part was 90 mm. The axial direction length of a relief portion was 10 mm. The maximum diameter of the plug was 54 mm. The outside diameter at the rear end of the nose part was 22 mm. The radius of curvature at the peripheral edge of the front end surface was 4 mm. The taper angle A22 excluding the peripheral edge of the front end of nose part was such that tan A22 equals 0.1.

Also, for comparison, by using the plug shown in FIG. 3 (hereinafter, referred to as the plug of comparative example), the same test was conducted. The plug of comparative example had no through hole. The axial direction length of the plug of comparative example was 110 mm. The axial direction length of the shell part was 100 mm. The axial direction length of a relief portion was 10 mm. The maximum diameter of the plug was 54 mm.

Figure 12:
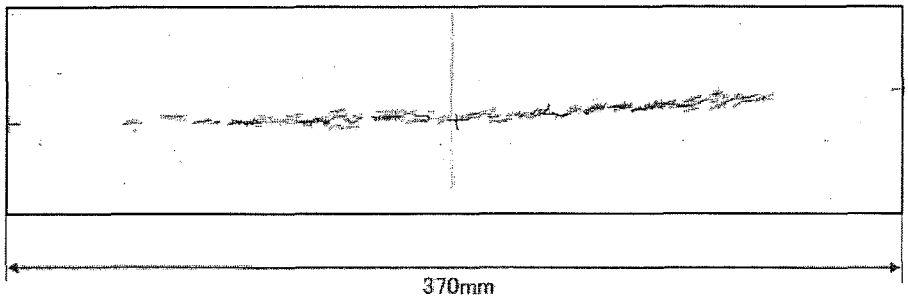
FIG. 12 is an X-ray photograph of a billet piercing-rolled by using the plug shown in FIG. 2A.
Figure 13:
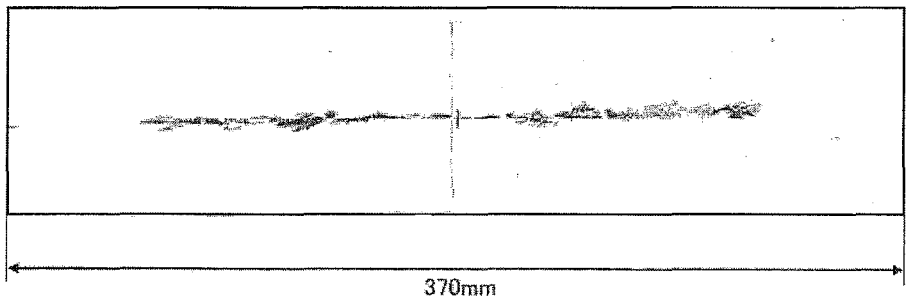
FIG. 13 is an X-ray photograph of a billet piercing-rolled by using the plug shown in FIG. 3.

First, the center defect in the billet was checked by an X-ray photograph. FIG. 12 shows an X-ray photograph of a billet piercing-rolled by using the plug of example embodiment of the present invention. FIG. 13 shows an X-ray photograph of a billet piercing-rolled by using the plug of comparative example. Each of the billets used had a center defect of the same degree.

The inner surface flaws of the plurality of hollow shells produced by using the plug of example embodiment of the present invention and the plug of comparative example were examined by the penetrant test (PT). Specifically, the hollow shell subjected to the penetrant test was cut along the axial direction, and the presence of inner surface flaw was observed visually.

Figure 14A:
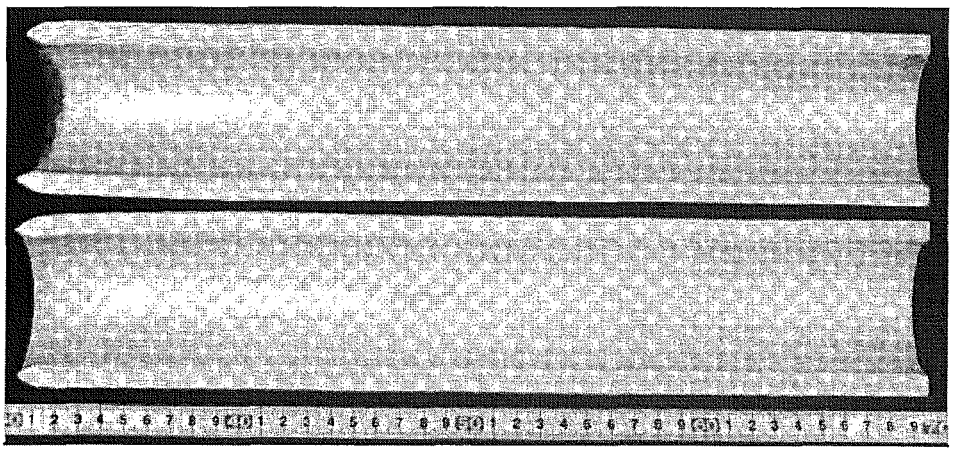
FIG. 14A is an inner surface PT photograph of a hollow shell formed by piercing-rolling a billet by using the plug shown in FIG. 2A, which is the inner surface PT photograph on one end side of the hollow shell.
Figure 14B:
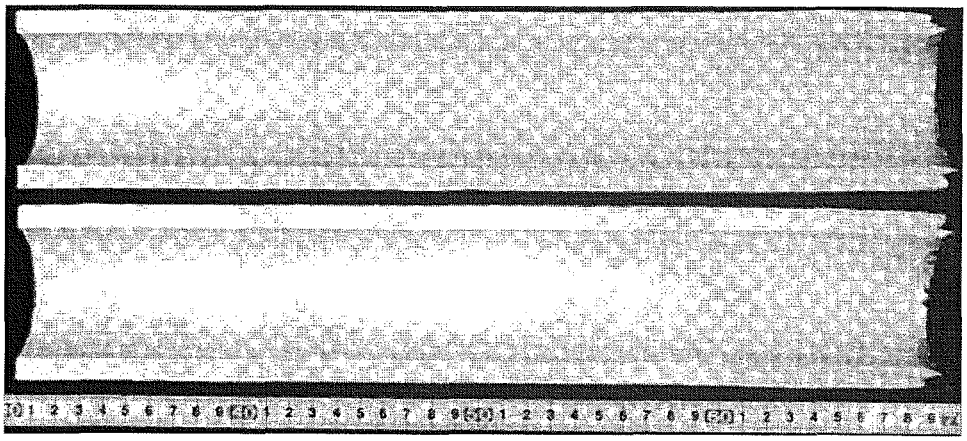
FIG. 14B is an inner surface PT photograph of a hollow shell formed by piercing-rolling a billet by using the plug shown in FIG. 2A, which is the inner surface PT photograph on the other end side of the hollow shell.
Figure 15A:
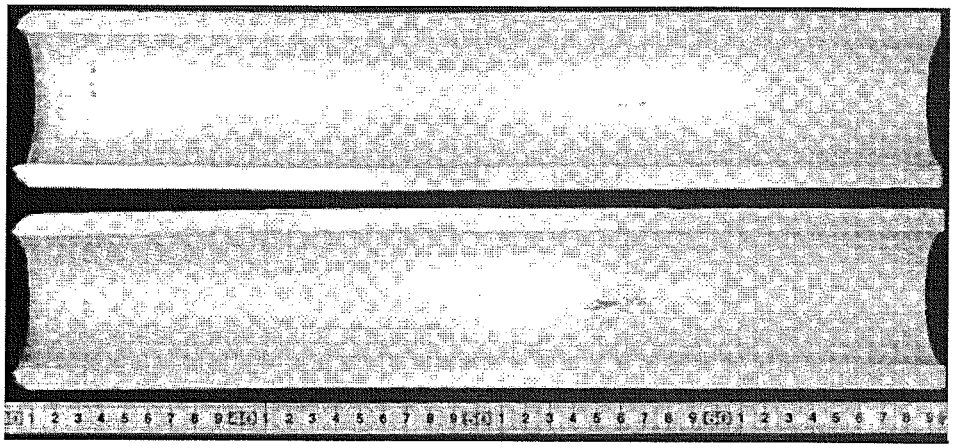
FIG. 15A is an inner surface PT photograph of a hollow shell formed by piercing-rolling a billet by using the plug shown in FIG. 3, which is the inner surface PT photograph on one end side of the hollow shell.
Figure 15B:
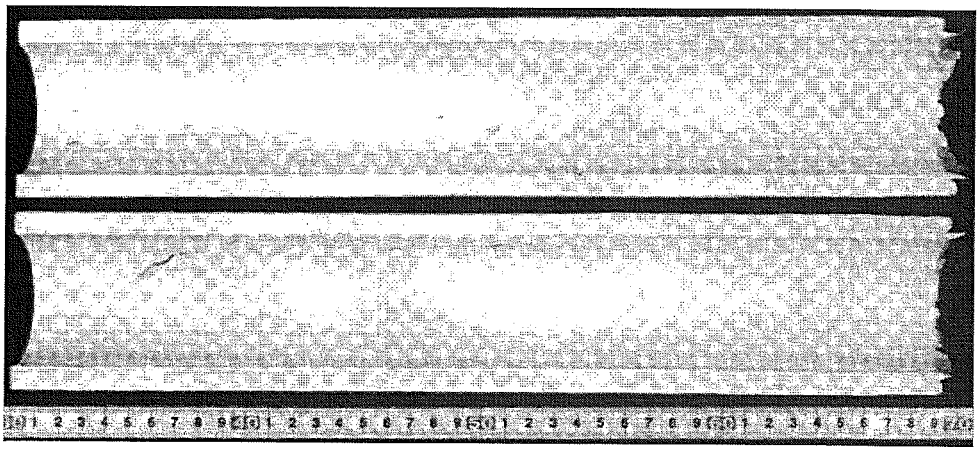
FIG. 15B is an inner surface PT photograph of a hollow shell formed by piercing-rolling a billet by using the plug shown in FIG. 3, which is the inner surface PT photograph on the other end side of the hollow shell.

FIGS. 14A and 14B show the inner surface PT photographs of the hollow shell formed by piercing-rolling a billet by using the plug of example embodiment of the present invention. FIGS. 15A and 15B show the inner surface PT photographs of the hollow shell formed by piercing-rolling a billet by using the plug of comparative example.

When the plug of example embodiment of the present invention was used, no inner surface flaw was observed in the hollow shell. On the other hand, when the plug of comparative example was used, inner surface flaws were observed in the hollow shell. Therefore, if the plug of example embodiment of the present invention was used, the occurrence of inner surface flaw in the hollow shell was able to be suppressed.

EXAMPLE 2

In press roll piercing, a check was made whether or not the occurrence of inner surface flaw attributable to the center defect in the square billet was suppressed.

Figure 16:
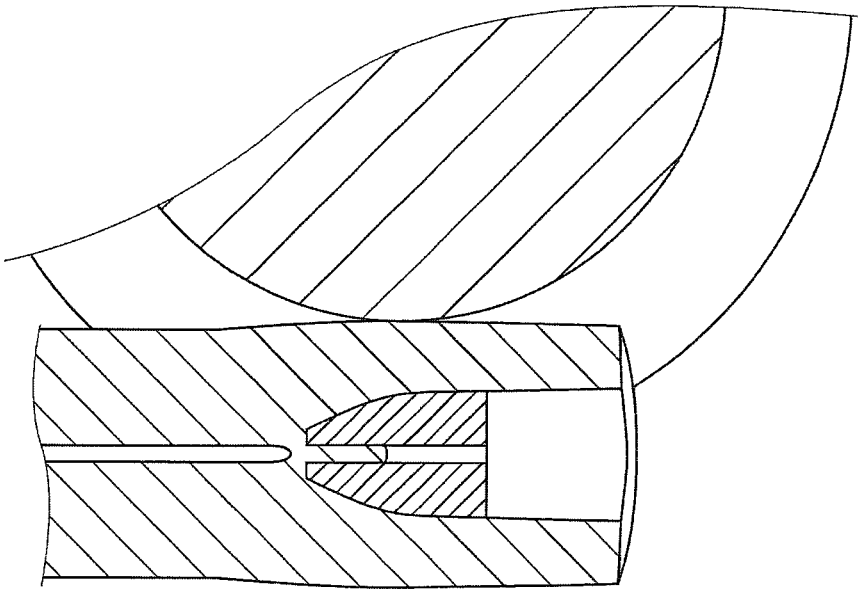
FIG. 16 is a schematic view showing an analysis model of numerical analysis using the three-dimensional rigid plastic finite element method, showing a state in which the central portion of a billet enters into the through hole in a plug.

FIG. 16 shows a state in which, in an analysis model of numerical analysis using the three-dimensional rigid plastic finite element method, the central portion of a billet enters into the through hole in a plug.

The analysis model was configured by one roll, a square billet, and a plug. In the numerical analysis, the cross section of the square billet was made such as to be of a square shape in which one side thereof was 122 mm, and the length of the square billet was made 300 mm. To simulate the center defect in the square billet, a center hole having a diameter of 7 mm was formed in the central portion of square billet. The steel type was made S45C specified in JIS Standard. The heating temperature of square billet was made 1200° C. The diameter of the rear end of plug was made 60 mm. The diameter of the through hole in the plug was made 7 mm. The diameter of the roll groove bottom was made 450 mm. The number of rotations of roll was made 10 rpm.

As shown in FIG. 16, the center hole formed in the central portion of square billet was pressed in front of the plug. Then, the central portion of square billet including the pressed center hole entered into the through hole in the plug. From this result, it was able to be estimated that the occurrence of inner surface flaw attributable to the center defect in the square billet would be suppressed.

EXAMPLE 3

In press-piercing, a check was made whether or not the occurrence of inner surface flaw attributable to the center defect in the billet was suppressed.

Figure 17:
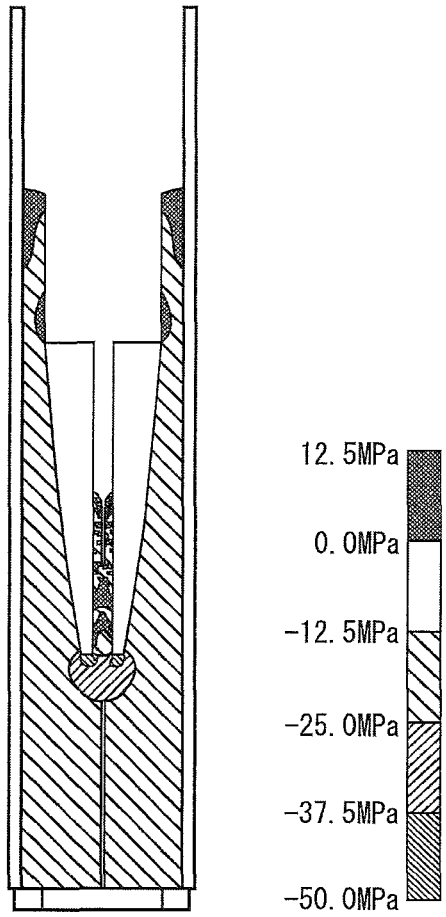
FIG. 17 is a view showing an analysis result obtained by numerical analysis using the two-dimensional rigid plastic finite element method, showing a distribution of hydrostatic pressures (average stresses).

FIG. 17 shows a distribution of hydrostatic pressures (average stresses) obtained by numerical analysis using the two-dimensional rigid plastic finite element method.

The numerical analysis was made by using an axisymmetric model. In the numerical analysis, the billet accommodated in the container had a diameter of 70 mm and an axial direction length of 240 mm. To simulate the center defect in the billet, a center hole having a diameter of 7 mm was formed in the central portion of billet. The steel type was made S45C specified in JIS Standard. The heating temperature of billet was made 1200° C. The maximum diameter of plug was made 60 mm. The diameter of the through hole in the plug was made 10 mm. The press speed was made 40 mm/s.

As shown in FIG. 17, a compressive stress occurred in front of the plug. Thereby, the center hole was pressed in front of the plug. Then, the central portion of billet including the pressed center hole entered into the through hole in the plug. From this result, it was able to be estimated that the occurrence of inner surface flaw attributable to the center defect in the billet would be suppressed.

EXAMPLE 4

In press-piercing, a check was made whether or not the occurrence of inner surface flaw attributable to the center defect in the billet was suppressed.

Figure 18:
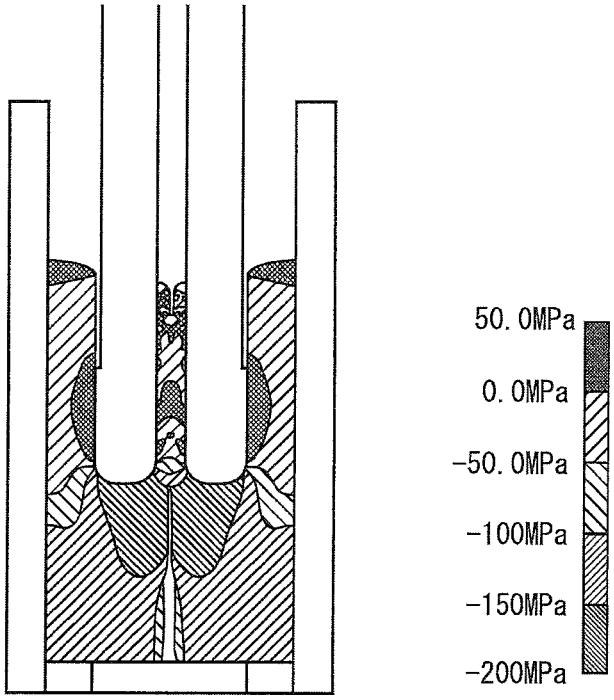
FIG. 18 is a view showing an analysis result obtained by numerical analysis using the two-dimensional rigid plastic finite element method, showing a distribution of hydrostatic pressures (average stresses).

FIG. 18 shows a distribution of hydrostatic pressures (average stresses) obtained by numerical analysis using the two-dimensional rigid plastic finite element method.

The numerical analysis was made by using an axisymmetric model. In the numerical analysis, the billet accommodated in the container had a diameter of 80 mm and an axial direction length of 140 mm. To simulate the center defect in the billet, a center hole having a diameter of 7 mm was formed in the central portion of billet. The steel type was made S45C specified in JIS Standard. The heating temperature of billet was made 1200° C. The plug was made such as to be of a cylindrical shape having an inside diameter of 10 mm and an outside diameter of 52 mm. That is, the diameter of the through hole that the plug had was 10 mm. The press speed was made 40 mm/s.

As shown in FIG. 18, a compressive stress occurred in front of the plug. Thereby, the center hole was pressed in front of the plug. Then, the central portion of billet including the pressed center hole entered into the through hole in the plug. From this result, it was able to be estimated that the occurrence of inner surface flaw attributable to the center defect in the billet would be suppressed. Also, since the plug was made such as to be of a cylindrical shape, a high compressive stress occurred through a wide range in front of the plug.

EXAMPLE 5

Figure 19:
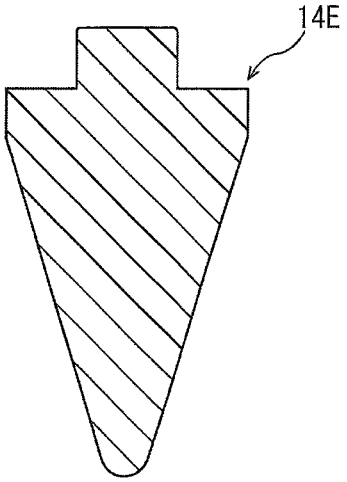
FIG. 19 is a sectional view showing a plug used for comparison in Example 4.

By using the plug shown in FIG. 11, the billet was press-pierced, and a check was made whether or not an inner surface flaw occurred in the obtained hollow shell (working example). Also, for comparison, by using a plug 14E (a plug having no through hole) shown in FIG. 19, the billet was press-pierced, and a check was made whether or not an inner surface flaw occurred in the obtained hollow shell (comparative example).

The billet was produced as described below.

First, a casting material having porosity in the central portion thereof was produced. The size of porosity was 8 to 10 mm at a maximum in the radial direction of casting material. The casting material having a diameter of 120 mm was bloomed to produce the billet.

The billet had a diameter of 100 mm and an axial direction length of 200 mm. The heating temperature of billet was 1220° C. For the plug of working example, the maximum outside diameter was 60 mm, and the diameter of through hole was 15 mm. For the plug of comparative example, the maximum outside diameter was 60 mm. The press speed was 40 mm/s. By using these plugs, ten billets were press-pierced for each of working example and comparative example. After the obtained hollow shell had been cleaned by pickling, the inner surface flaw was examined by the penetrant test (PT).

When the plug of comparative example was used, the inner surface flaw was checked, but when the plug of working example was used, the inner surface flaw was not checked.

The above is a detailed description of embodiments of the present invention. These embodiments have merely been described exemplarily, and the present invention is not restricted by the above-described embodiments.

The invention claimed is:

1. A piercing apparatus for piercing a billet, comprising:

a plug having a through hole which extends along a central axis of the plug and through which a central portion of the billet being pierced is allowed to pass, and a mandrel connected to a rear end of the plug, the mandrel having a connection hole extending on a central axis of the mandrel and connectable to the through hole, a size of the connection hole being equal to or larger than a size of the through hole at a position where the connection hole connects to the through hole.

2. The piercing apparatus according to claim 1, wherein the plug comprises:

a shell part having an outside diameter which increases from a front end of the plug toward the rear end thereof; and a nose part which is provided at a front end of the shell part, and protrudes to an axial direction of the plug, and the through hole has an opening in a center of a front end of the nose part.

3. The piercing apparatus according to claim 2, wherein the nose part has an outside diameter which increases from the front end of the plug toward the rear end thereof; and a taper angle of a fore end portion of the shell part is larger than a taper angle of a rear end portion of the nose part.

4. The piercing apparatus according to claim 3, wherein a front end surface of the nose part is flat.

5. The piercing apparatus according to claim 3, wherein a peripheral edge of the front end surface of the nose part is rounded.

6. The piercing apparatus according to claim 1, wherein a transverse cross-sectional shape of the through hole increases from a front end of the plug toward the rear end thereof.

7. The piercing apparatus according to claim 1, wherein the piercing apparatus further comprises a plurality of rolls arranged around an axial direction of the plug.

8. The piercing apparatus according to claim 7, wherein the piercing apparatus is of an inclined rolling type in which each of the plurality of rolls is an inclined roll.

9. The piercing apparatus according to claim 7, wherein the piercing apparatus is of a press roll type, and wherein the piercing apparatus further comprises a pusher rod for pushing the billet into the plug, and each of the plurality of rolls is a grooved roll.

10. The piercing apparatus according to claim 1, wherein the piercing apparatus is a piercing press type, and wherein the piercing apparatus further comprises a container for accommodating the billet, and the plug press-pierces the billet in an axial direction of the billet.

11. A method for producing a seamless steel pipe, comprising the steps of:

preparing a piercing apparatus comprising a plug having a through hole extending along a central axis of the plug and a mandrel connected to a rear end of the plug, the mandrel having a connection hole extending on a central axis of the mandrel and connectable to the through hole, a size of the connection hole being equal to or larger than a size of the through hole at a position where the connection hole connects to the through hole; and piercing a billet by using the piercing apparatus while a central portion of the billet is allowed to pass through the through hole in the plug.

* * * * *